US011149481B2

(12) United States Patent
Tanriverdi

(10) Patent No.: US 11,149,481 B2
(45) Date of Patent: Oct. 19, 2021

(54) FURNITURE HINGE

(71) Applicant: SAMET KALIP VE MADEN ESYA SAN. VE TIC A.S., Istanbul (TR)

(72) Inventor: Himmet Tanriverdi, Esenyurt-Istanbul (TR)

(73) Assignee: SAMET KALIP VE MADEN ESYA SAN. VE TIC A.S.

( * ) Notice: Subject to any disclaimer, the term of this patent is extended or adjusted under 35 U.S.C. 154(b) by 414 days.

(21) Appl. No.: 16/323,965

(22) PCT Filed: Aug. 19, 2016

(86) PCT No.: PCT/EP2016/069747
§ 371 (c)(1),
(2) Date: Feb. 7, 2019

(87) PCT Pub. No.: WO2018/033221
PCT Pub. Date: Feb. 22, 2018

(65) Prior Publication Data

US 2019/0211597 A1 Jul. 11, 2019

(51) Int. Cl.
*E05D 7/12* (2006.01)
*E05F 5/00* (2017.01)
*E05D 7/04* (2006.01)

(52) U.S. Cl.
CPC ..... *E05D 7/123* (2013.01); *E05F 5/006* (2013.01); *E05D 7/0415* (2013.01);
(Continued)

(58) Field of Classification Search
CPC ..... Y10T 16/5357; Y10T 16/5358; Y10T 16/5383; E05D 7/123; E05D 7/125;
(Continued)

(56) References Cited

U.S. PATENT DOCUMENTS 4,312,098 A 1/1982 Sundermeier
4,691,408 A * 9/1987 Rock ..... E05D 7/125 16/241
(Continued)

FOREIGN PATENT DOCUMENTS

DE 7924808 U1 11/1979
DE 3939080 A1 * 5/1990 ..... E05D 7/125
(Continued)

OTHER PUBLICATIONS

PCT Search Report of PCT/EP2016/069747, dated Apr. 20, 2017, 10 pages (not prior art).
(Continued)

*Primary Examiner* — Chuck Y Mah
(74) *Attorney, Agent, or Firm* — Lucian Wayne Beavers; Patterson Intellectual Property Law, PC

(57) ABSTRACT

The invention relates to a furniture hinge for the articulated securing of a furniture door, leaf or similar to a furniture body, in particular to a frame of a furniture body, comprising a mounting plate for securing the furniture hinge to the furniture body and a hinge body for securing the furniture hinge to the furniture door, leaf or similar, wherein a pivotally mounted hinge arm is associated with the hinge body and wherein the hinge arm can be secured to the mounting plate directly or via at least one connection element secured to the hinge arm. In addition, the hinge arm can be secured to the mounting plate indirectly or directly via a connection system that can be closed without tools. The furniture hinge permits a quick and secure mounting of a furniture door, leaf or similar to a furniture body.

14 Claims, 8 Drawing Sheets

(52) U.S. Cl.
CPC ..... *E05D 2007/128* (2013.01); *E05Y 2600/53* (2013.01); *E05Y 2900/20* (2013.01)

(58) Field of Classification Search
CPC ..... E05D 7/0415; E05D 7/0423; E05F 5/006; E05F 5/02; E05F 5/06; E05F 5/10; E05F 2007/0492; E05F 2007/128; E05Y 2600/53; E05Y 2900/20
See application file for complete search history.

(56) References Cited

U.S. PATENT DOCUMENTS 4,750,238 A * 6/1988 Rock ..... E05D 7/0407 16/241
4,799,290 A * 1/1989 Lautenschlager, Jr. ..... E05D 7/0407 16/237
4,800,621 A * 1/1989 Rock ..... E05D 7/0407 16/235
4,839,940 A * 6/1989 Grass ..... E05D 7/125 16/258
5,022,116 A * 6/1991 Salice ..... E05D 7/0407 16/258
5,056,189 A * 10/1991 Brustle ..... E05D 7/125 16/235
5,224,242 A * 7/1993 Marjanovic ..... E05D 7/125 16/258
5,245,727 A * 9/1993 Sasaki ..... E05D 5/08 16/240
5,577,296 A 11/1996 Grass
5,611,112 A 3/1997 Roeck et al.
5,781,966 A * 7/1998 Ferrari ..... E05D 7/0407 16/242
5,791,016 A * 8/1998 Lenz ..... E05D 5/0246 16/258
6,032,333 A * 3/2000 Brustle ..... E05D 7/0407 16/240
6,148,479 A * 11/2000 Lin ..... E05D 7/125 16/236
6,266,848 B1 * 7/2001 Fraccaro ..... E05D 7/0407 16/241
6,883,204 B2 4/2005 Salice
7,017,231 B2 * 3/2006 Isele ..... E05D 7/0407 16/242
7,065,833 B2 * 6/2006 Kropf ..... E05D 3/142 16/286
7,178,199 B2 * 2/2007 Kashiwaguma ..... E05D 7/125 16/258
7,321,691 B1 * 1/2008 Sunshine ..... G06K 9/0063 382/191
7,509,708 B1 * 3/2009 Radke ..... E05D 7/0415 16/237
7,917,995 B2 * 4/2011 Salice ..... E05F 5/02 16/288
8,505,165 B2 * 8/2013 Domenig ..... E05F 5/006 16/286
8,561,262 B1 * 10/2013 Liang ..... E05F 5/04 16/286
8,650,711 B1 2/2014 Chen et al.
2004/0216272 A1 11/2004 Booker et al.
2006/0137139 A1 * 6/2006 Wu ..... E05D 7/0415 16/236
2012/0126677 A1 * 5/2012 Ahlfeld ..... E05F 5/006 312/326
2012/0174338 A1 * 7/2012 Wu ..... E05F 5/006 16/297

FOREIGN PATENT DOCUMENTS

EP 1367203 A2 12/2003
JP 01247679 A * 10/1989

OTHER PUBLICATIONS

English translation of the PCT search report of PCT/EP2016/069747, dated Apr. 20, 2017, 10 pages (not prior art).

* cited by examiner

FURNITURE HINGE

BACKGROUND OF THE INVENTION

1. Field of the Invention

The invention relates to a furniture hinge for the articulated fastening of a furniture door, flap or the like to a furniture carcass, in particular to a frame of a furniture carcass, having a mounting plate for fastening the furniture hinge to the furniture carcass and a hinge body for fastening the furniture hinge to the furniture door, flap or the like, wherein the hinge body has assigned thereto a pivotably mounted hinge arm and wherein the hinge arm is fastenable to the mounting plate directly or via at least one connection element which is fastened to the hinge arm.

2. Description of the Prior Art

Document EP 1 367 203 A2 discloses a furniture hinge with a hinge cup and a base plate which is hinged via a multi-part arm connection. To this end, a hinge arm is connected to the base in an articulated manner plate. Located opposite, an angled holding arm is fastened to the hinge arm via a first eccentric. A second eccentric connects the holding arm located opposite the first eccentric to an arm portion which is fastened to the base plate via a third eccentric. The base plate can be fastened by means of fastening screws to a furniture wall, in particular to the front face of a vertically extending frame of the item of furniture (face frame). The hinge cup is fixed to a furniture door. The eccentrics each enable linear adjustment such that the furniture door is able to be adjusted in three directions in space in relation to the furniture wall. They connect the portions of the arm connection and the base plate permanently such that the furniture hinge is only able to be mounted as a contiguous component. To fasten the furniture door to the furniture carcass, the door has accordingly to be held by a fitter whilst he simultaneously screws the base plate to the furniture wall. This requires effort and time and can result in the door being mounted inaccurately or in the item of furniture being damaged if the fitter drops the door in unfavorable installation situations. The mounting is difficult in particular in the case of items of furniture where the furniture hinge is fastened on the front face of a frame (face frame), as there is only a small contact surface present here for the base plate.

DE 7 924 808 U1 discloses a cabinet with a door which is mounted so as to be pivotable about a vertical axis. A mounting block of a hinge is screwed to a vertically extending strip of the cabinet. Located opposite, a hinge cup is provided in a corresponding bore in a furniture door of the cabinet and is connected to said door. A hinge arm, which is connected in an articulated manner to the hinge cup, is guided to the mounting block and fastened to said mounting block by means of a screw. To mount the door, first of all the hinge cup is accordingly attached to the door and the mounting block is attached to the strip of the cabinet. The door is then aligned in relation to the carcass of the cabinet such that the hinge arm abuts against the mounting block and is able to be screw-connected thereto. Here too, the door has to be held by a fitter and at the same time a tool has to be actuated to screw in the connecting screw between the hinge arm and the mounting block. This requires effort and can, in particular in the case of unfavorable installation situations, result in the fitter skewing or dropping the door, which can result in damage to the door or to the item of furniture.

SUMMARY OF THE INVENTION

It is consequently the object of the invention to provide a furniture hinge which makes it possible to mount, in a simple manner, a furniture door on a furniture carcass of an item of furniture, in particular on a frame (face frame) of the furniture carcass.

The object of the invention is achieved in that the hinge arm is fastenable to the mounting plate indirectly or directly via a connection system which is to be closed in a tool-free manner. As a result of the two-part realization of the furniture hinge, one hinge part (mounting plate) can be pre-mounted on the furniture carcass, in particular on a frame of the furniture carcass, and one hinge part (hinge body) on the furniture door. The furniture door can then be held by a fitter on the furniture carcass and the two hinge parts (mounting plate and hinge body) can be connected together. As no tool is required to do this, the fitter has both hands free to hold the furniture door and to join the hinge parts. This makes mounting considerably simpler. For example, no screw connections joining the hinge parts have to be screw-connected using a screwdriver, as a result of which it is also possible to reduce the mounting time significantly.

It can preferably be provided that the connection system can be opened and the hinge arm released from the mounting plate in a tool-free manner. This also simplifies disassembly of the furniture door in a considerable manner. Here too, the fitter has both hands free to hold the furniture door and to release the connection between the hinge arm and the mounting plate. This means that the risk of the furniture door being dropped and damaged during disassembly is considerably reduced.

Corresponding to a preferred design variant of the invention, it can be provided that the connection system comprises at least one movably mounted blocking element which fixes the hinge arm or the connection element connected to the hinge arm to the mounting plate in a first position and releases it in a second position. For mounting the furniture door, the two hinge parts have simply to be aligned in relation to one another and, in this case, the blocking element has to be adjusted between its two positions. The changeover between the two positions can be effected quickly so that the fitter only has to hold the furniture door briefly and consequently without much effort. The two positions are clearly defined so that incorrect mounting can be ruled out to the greatest possible extent.

The mounting of the furniture door can be further simplified as a result of the blocking element being held in the first position by a spring and of the blocking element being adjustable into the second position against the spring force applied by the spring. The blocking element is consequently adjusted into its first position without the effect of any external force. In said first position, the mounted hinge arm is fixed to the mounting plate. The spring consequently ensures that the hinge arm is held securely on the mounting plate without any external force applied and is not released unintentionally. For mounting or disassembly of the furniture door, the blocking element can be adjusted simply and quickly into its second position and the connection between the hinge arm and the mounting plate can be released.

In dependence on the installation situation of the furniture hinge, good accessibility of the blocking element can be achieved as a result of the blocking element being arranged on the hinge arm or on the connection element connected to the hinge arm or on the mounting plate.

The mounting of the furniture door can be facilitated in particular as a result of the blocking element being adjustable from its first position into its second position by the mounting movement between the hinge arm or the connection element fastened to the hinge arm and the mounting plate and of the blocking element, with the hinge arm or the connection element fastened on the hinge arm in the mounted position on the mounting plate, being adjusted by the spring into its first position. A fitter has accordingly simply to align the furniture door in relation to the furniture carcass and, for example, to press the hinge arm onto the mounting plate. The hinge parts are connected as a result of said mounting movement. In an advantageous manner, the fitter does not have to operate the blocking element separately by hand for this purpose. Consequently, he has both hands free to hold the furniture door directly and on the hinge arm to be moved corresponding to the necessary mounting movement.

A reliable and loadable connection between the hinge body and the mounting plate can be achieved as a result of the hinge arm or the connection element fastened to the hinge arm comprising at least one hook which is hookable into a hook receiving means of the mounting plate and/or of the mounting plate comprising at least one hook which is hookable into a hook receiving means of the hinge arm or of the connection element fastening to the hinge arm and of the at least one movably mounted blocking element blocking the hooked-in hook in the hook receiving means in its first position and releasing it in its second position. The hook or hooks, in this case, can be realized such that they are able to transmit large forces to the hook receiving means. The blocking element serves for the purpose of not allowing the hooks to be able to slide out of the hook receiving means. The mounting movement includes the insertion of the hooks into the hook receiving means and the adjustment of the locking element.

Corresponding to a particularly preferred design variant, it can be provided that the blocking element is formed by a pivotably mounted claw. The claw comprises a claw opening in which a portion of the oppositely situated hinge part is inserted and, as a result, is able to be blocked. As a result of the pivoting movement, the claw can be adjusted between the first position, in which the connection system is blocked, and the second position in which the connection system is not blocked.

It can preferably be provided, in this case, that, with the furniture hinge mounted, the claw encompasses a holding portion of the hinge arm or of the connection element or of the mounting plate by way of a claw opening and/or that the claw comprises a run-up slope which, during the connecting operation, is guided into the adjustment path of the holding portion between the hinge arm or the connection element fastened on the hinge arm and the mounting plate. In a particularly preferred manner, in this case, the claw is pressed into its first position by a spring force. The holding portion is pressed against the run-up slope for mounting. The holding portion, in this case, slides along the run-up slope and presses it to the side. As a result, the pivotably mounted claw is adjusted into its second position, preferably in opposition to a spring force. In said second position, the holding portion slides into the claw opening. The pressure is consequently lifted off the run-up slope and the claw pivots back into its first position again. The holding portion is now held in the claw opening. The hinge arm is consequently fixed in relation to the mounting plate.

A sturdy connection between the hinge body and the mounting plate can be achieved as a result of the claw opening being aligned opposite to an opening of the at least one hook in the first position of the claw. When the furniture door is being mounted, the hook can thus first of all be hooked into the assigned hook receiving means. A movement between the hinge arm and the mounting plate, by means of which the hook slides out of the hook receiving means again, is then blocked by the claw.

A connection, which is easy and quick to mount, between the hinge body and the mounting plate can be provided as a result of the hinge arm or the connection element fastened to the hinge arm comprising at least one latching element and of the mounting plate comprising at least one latching receiving means corresponding thereto into which the latching element is latchable and/or as a result of the mounting plate comprising at least one latching element and of the hinge arm or the connection element fastened to the hinge arm comprising at least one latching receiving means corresponding thereto into which the latching element is latchable. The hinge body, for mounting, has simply to be aligned in relation to the mounting plate and the two hinge parts then pressed against one another such that the latching elements latch into the latching receiving means.

In order to be able to align the furniture door in relation to the furniture carcass at least in one direction in space, it can be provided that the position of the hinge arm is adjustable in relation to the connection element. The connection element is connected to the mounting plate which is fastened to the carcass. The hinge arm is fastened to the furniture door. As a result of modifying the position of the hinge arm in relation to the connection element, the furniture door is consequently able to be adjusted relative to the furniture carcass.

An alternative or additional alignment of the furniture door in relation to the furniture carcass, can be made possible as a result of the mounting plate comprising a base plate and a cover, of the hinge arm being fastenable indirectly or directly to the cover and of the position of the cover being adjustable in relation to the base plate. The base plate is fastened to the furniture carcass. The furniture door is thus able to be adjusted in multiple, preferably in three directions in space in relation to the furniture carcass.

Easy and positionally accurate mounting of the furniture hinge on a frame of the furniture carcass (face frame) can be made possible as a result of the mounting plate comprising a mounting surface for abutment against the furniture carcass, in particular the frame, and of a stop projecting beyond the mounting surface. For mounting, the mounting surface can be placed onto the frame. In this case, the stop can be pressed onto the edge of the frame. The mounting plate is thus aligned in relation to the frame. The bores, through which the mounting plate is screw-connected to the frame, are consequently arranged precisely with respect to the frame, for example centrally on the frame. This can prevent the mounting screws being screw-connected too close to the edge of the frame and tearing out under load.

Corresponding to an advantageous design of the invention, it can be provided that the hinge cup comprises a centering region and a mounting region with a cup depth which is reduced in relation to the centering region, that a housing with a damper is fastened from the outside to the cup bottom of the hinge cup in the mounting region, that a piston or a cylinder is guided through an opening into the centering region and that an articulated lever of a hinge arm is mounted in the centering region so as to be pivotable. The housing with the damper is consequently not arranged in the interior of the hinge cup. As a result, with the furniture hinge mounted, the interior of the hinge cup is free, easily accessible and simple to clean. The surface of the hinge cup, which is visible when the furniture hinge is installed, can be produced uniformly, for example from metal. This produces an even and high-quality impression of the furniture hinge with the surface at the same time having a high mechanical strength. The damper itself is arranged with its housing behind the hinge cup, protected against external stresses and against contaminants. The damper and the housing are thus able to be produced in a cost-efficient manner, for example from plastics material that is soft compared to metal. As a result of arranging the housing with the damper on the mounting region with the cup depth reduced in relation to the centering region, the external dimensions of the assembly remain the same compared to hinge cups of known furniture hinges such that the hinge cup is able to be inserted into standardized bores on the item of furniture piece and fastened. For mounting the item of furniture, the furniture hinge is preferably present as a pre-mounted structural unit where the housing is already fastened with the damper on the mounting region. The furniture hinge is thus able to be fastened simply and quickly on the item of furniture. In this case, the centering region enables the hinge cup to be positioned precisely in the standardized bore and consequently on the item of furniture. As a result of a piston or a cylinder of the damper being guided into the centering region and consequently into the actuating path of the articulated lever, the movement of the furniture door is able to be damped during the closing operation.

BRIEF DESCRIPTION OF THE DRAWINGS

The invention is explained in more detail below by way of an exemplary embodiment shown in the drawings, in which.

DETAILED DESCRIPTION

Figure 1:
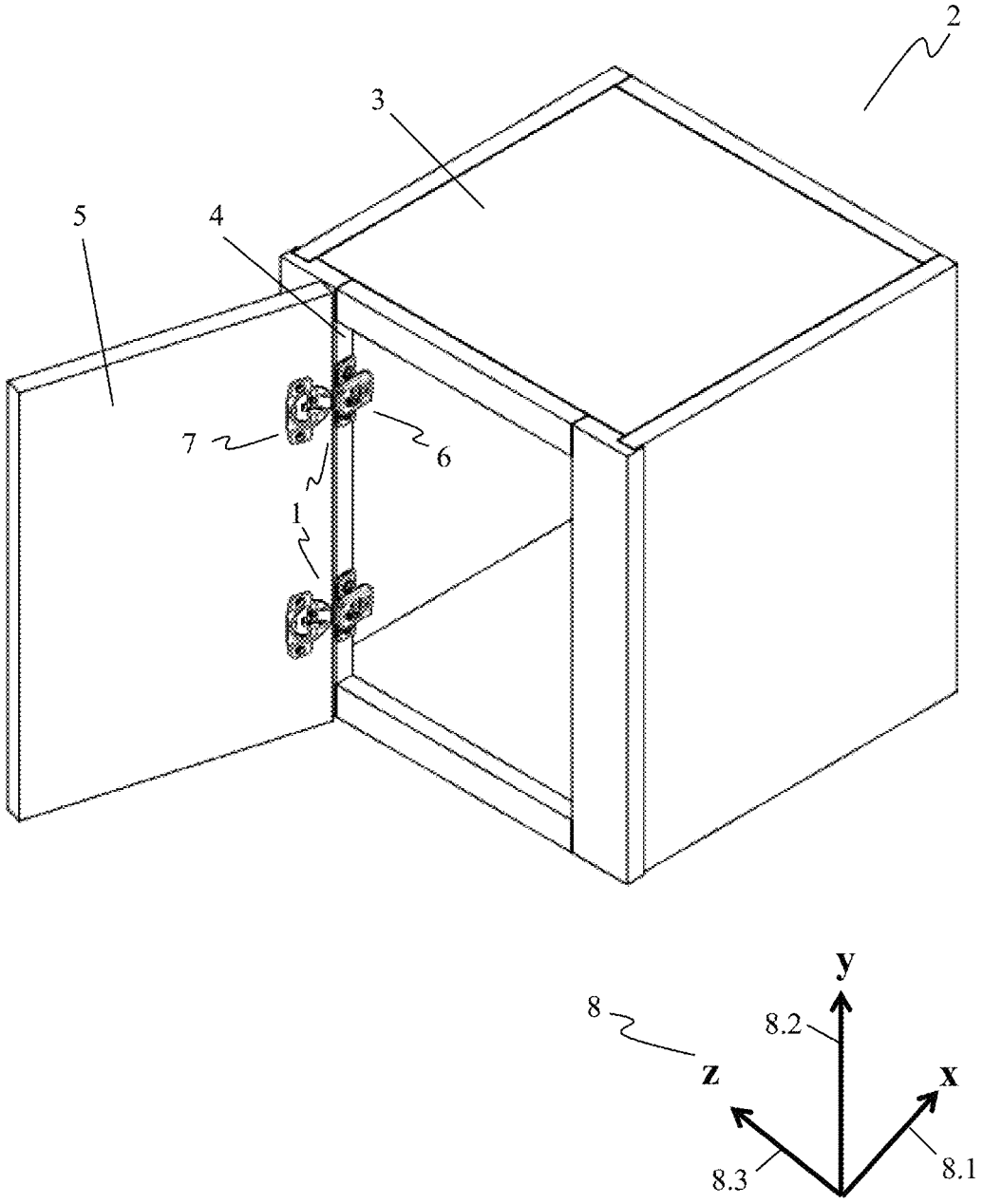
FIG. 1 shows a perspective view of an item of furniture with a pivotably mounted furniture door.

FIG. 1 shows a perspective view of an item of furniture 2 with a pivotably mounted furniture door 5. The furniture door 5 is fastened to a frame 4 of a furniture carcass 3 by way of two furniture hinges 1. Each furniture hinge 1 has assigned thereto a mounting plate 6 and a hinge body 7. The hinge body 7 is connected to the furniture door 5. The mounting plate 6 is fixed to the frame 4. In this case, the mounting plate 6 is fastened to the end face of the frame 4. Such a form of mounting is also known as a face frame and is used, in particular, in the US-American market. The furniture hinges 1 make it possible to open and close the furniture door 5 in a pivoting movement. The furniture door 5 may also be referred to as a pivoted furniture part.

A system of coordinates 8 indicates, with reference to the alignment of the item of furniture 3, three directions in space, namely an x direction 8.1, a y direction 8.2 and a z direction 8.3. The directions in space specify possible directions of adjustment of the furniture door 5, as are made possible by the furniture hinges 1.

Figure 2:
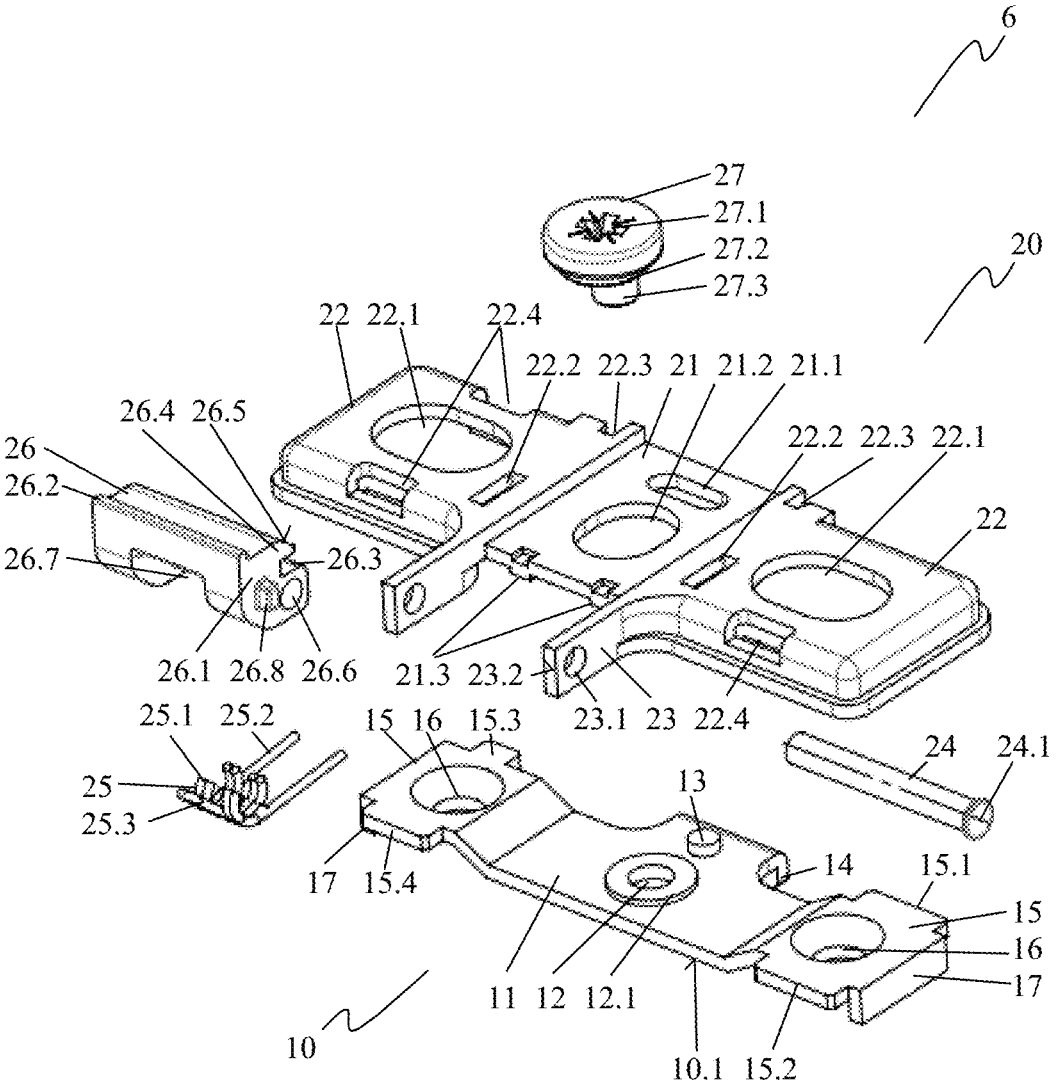
FIG. 2 shows an exploded drawing of a mounting plate for fastening the furniture hinge to a furniture carcass.

FIG. 2 shows an exploded drawing of the mounting plate 6 for fastening the furniture hinge 1 to a furniture carcass 3. The mounting plate 6 has assigned thereto a base plate 10 and a cover 20.

The base plate 10 serves for fastening the mounting plate 6 to the item of furniture 2 shown in FIG. 1. It is realized for this purpose preferably as a stamped part, in particular as a sheet metal stamped part. A central part 11 comprises a bore 12. An edge 12.1 extends around the bore 12. The edge 12.1 is elevated opposite to a mounting surface 10.1 of the base plate 10. A shoulder 13 is integrally molded on the central part 11 also opposite to the mounting surface 10.1. The shoulder 13 comprises a cylindrical form. The bore 12 and the shoulder 13 are arranged along a central line of the base plate 10. The mounting surface 10.1 serves as a contact surface on the item of furniture 2. A stop 14 is integrally molded onto the base plate 10. The stop 14 is realized as a region which is angled in relation to the central part 11. The stop 14 is angled in the direction of the mounting surface 10.1, preferably at right angles, in relation to the central part 11. It serves for positioning the base plate 10 and/or the mounting plate 6 in a precise manner on an edge of the frame 4 of the item of furniture 2. Laterally of the central part 11, two side parts 15 are integrally formed opposite one another on the central part 11. The side parts 15 are connected to the central part 11 via slopes. The plane of the side parts 15 is arranged offset away from the mounting surface 10.1 in relation to the plane of the central part 11. The side parts 15 are preferably aligned parallel to the central part 11. Remote from the central part 11, the side parts 15 are closed off by support portions 17. The support portions 17 are realized in an angled manner in relation to the side parts 15. They end in the plane of the mounting surface 10.1. The side parts 15 are each penetrated by a mounting bore 16. The mounting bores 16 are chamfered on the side remote from the mounting surface 10.1. Two latching portions 15.1, 15.2, 15.3, 15.4 are integrally molded on each of the side parts 15. The latching portions 15.1, 15.2, 15.3, 15.4 are aligned transversally to a connecting line between the two side parts 15 and in the plane of the side parts 15. They have varying widths between them.

The cover 20 comprises two oppositely situated flanges 22 laterally of a guide portion 21. The guide portion 21 is realized in a flat manner. It is penetrated by two elongated holes 21.1, 21.2. In this case, the first elongated hole 21.1 is aligned transversely (along the x axis shown in FIG. 1) and the second elongated hole 21.1 longitudinally (along the y axis shown in FIG. 1) to the alignment of a pivot axis of the furniture hinge 1. The flanges 22 are preferably realized as deep-drawn parts. They enclose a cavity which is open in the direction of the base plate 10. A third elongated hole 22.1 is arranged in each flange 22. The third elongated holes 22.1 are aligned in the direction of the pivot axis of the furniture hinge (y axis). Recesses 22.4 are provided in the bending edges of the flanges 22 which are realized as deep-drawn parts.

Two holding webs 23 are integrally molded onto the cover 20. The holding webs 23 comprise a cuboid contour. They are integrally molded onto the cover in the transition regions of the flanges 22 to the guide portion 21. The surface normal of the holding webs 23 is aligned in the direction of the pivot axis of the furniture hinge 1 (y axis). The holding webs 23 are arranged spaced apart from one another. A spindle bore 23.1 is provided in each holding web 23. The spindle bores 23.1 are arranged flush with one another. On their end remote from the guide portion 21, the holding webs 23 realize stop surfaces 23.2. Spring guides 21.3 are arranged on the edge of the guide portion 21 pointing toward the holding webs 23. The spring guides 21.3 are molded, in particular stamped, into the guide portion 21 spaced apart from one another. They are consequently realized from two nubs pointing in the direction of the base plate 10. A guide slot 22.2 is molded into each flange 22 facing the guide portion 21. The guide slots 22.2 comprise a rectangular cross-sectional surface. Their longitudinal extension is aligned transversely to the pivot axis of the furniture hinge 1. In particular, the guide slots 22.2 are aligned in the same direction as the holding webs 23. Two hook receiving means 22.3 are provided on the cover 20. The hook receiving means 22.3 are molded into the flanges 22 opposite to the holding webs 23. In this case, the hook receiving means 22.3 are realized as grooves which extend in the edges of the flanges 22 and are aligned in the direction of the base plate 10.

Figure 5:
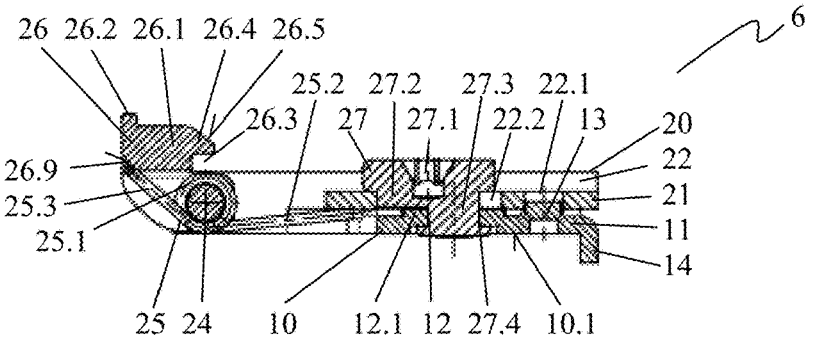
FIG. 5 shows a sectional representation from the side of the mounting plate shown in FIG. 3.

The mounting plate 6 has assigned thereto a claw 26. The claw 26 serves as a blocking element. It comprises an elongated basic body 26.1. A web 26.2 is integrally molded on said basic body 26.1 along it. A claw jaw 26.4 is also integrally molded on said basic body 26.1 along it. Together with the basic body 26.1, it delimits a claw opening 26.3. The claw opening 26.3 is consequently aligned along the longitudinal extension of the claw 26. On the side remote from the claw opening 26.3, the claw jaw 26.4 comprises a run-up slope 26.5. The claw jaw 26.4 is consequently tapered proceeding from the basic body 26.1. The claw 26 is penetrated by a spindle receiving means 26.6. The spindle receiving means 26.6 is realized as a bore which extends in the longitudinal extension of the claw 26. In this case, the spindle receiving means 26.6 connects the oppositely situated end faces of the claw 26. Stop cams 26.8 are arranged on the end faces of the claw 26. In the central region of the claw 26, a spring receiving means 26.7 is molded into the basic body 26.1 as a recess. The spring receiving means 26.7 realizes a spring contact surface 26.9 which is shown in FIG. 5.

The claw 26 has assigned thereto a spring 25. The spring 25 comprises a winding region 25.1 which is connected to a spring clip 25.3. The ends of the spring 25 are realized as legs 25.2. The length of the winding region 25.1 is designed such that the spring 25 is able to be arranged in the spring receiving means 26.7 of the claw 26. The legs 25.2 of the spring 25 are aligned in the direction of the guide portion 21 of the cover 20.

In addition, the mounting plate 6 has assigned thereto a spindle 24. The spindle 24 is realized in a cylindrical manner. It comprises a thickening on the end face. The spindle 24 is aligned in the direction of the spindle bores 23.1 in the holding webs 23.

A first eccentric 27 comprises a tool receiving means 27.1, a guide region 27.2 and an eccentric cam 27.3. In this case, the cylindrical guide region 27.2 is realized such that, mounted in the second elongated hole 21.2 of the guide portion 21, it is guided to the cover 20. The eccentric cam 27.3 is arranged outside the central axis of the guide region 27.2. The diameter of the eccentric cam 27.3 is designed so that it matches the diameter of the bore 12 of the base plate 10.

Figure 3:
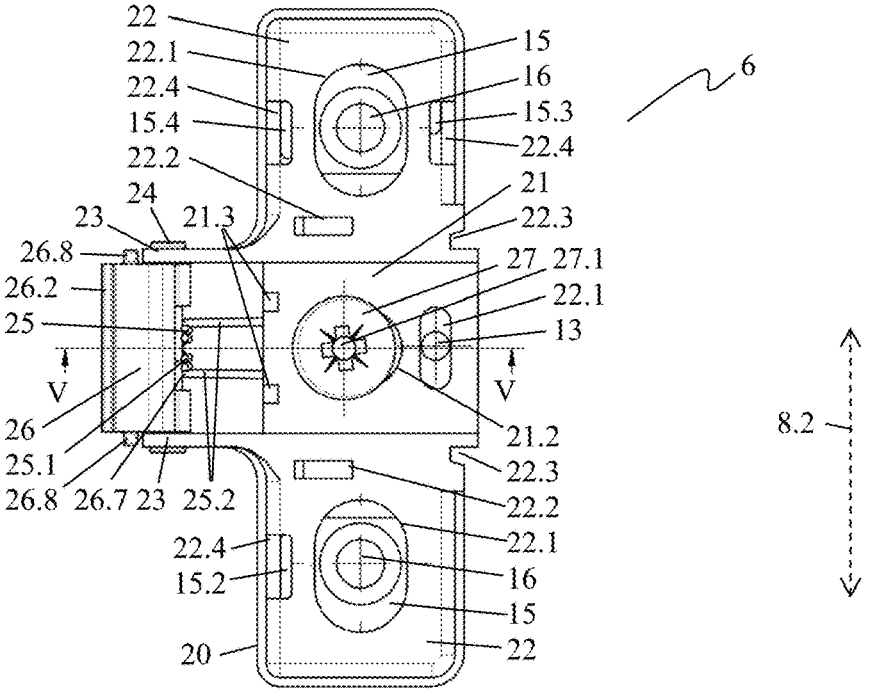
FIG. 3 shows a top view of the assembled mounting plate shown in FIG. 2.

FIG. 3 shows a top view of the assembled mounting plate 6 show in FIG. 2. The cover 20 is placed onto the base plate 10 and is latched with said base plate. To this end, the flanges 22 of the cover 20 are pressed onto the side parts 15 of the base plate 10 such that the latching portions 15.1, 15.2, 15.3, 15.4 latch into corresponding latching receiving means on the inside of the flanges 22. The latching connection is designed such that lifting the cover 20 from the base plate 10 is blocked but it is possible to move the cover 20 to the side in the direction of the y axis 8.2 in relation to the base plate 10. At least part of the latching portions 15.2, 15.3, 15.4 is accessible via the recesses 22.4 in the cover 20. As a result of inserting a suitable tool into the recesses 22.4, the latching connection between the cover 20 and the base plate can be released again. The mounting bores 16 of the base plate 10 are accessible via the third elongated holes 22.1 in the flanges 22 of the cover. The mounting plate 6 can thus be screwed onto the furniture carcass 3 by means of suitable screws. The shoulder 13 of the base plate 10 is guided in the first elongated hole 22.1 of the cover along the y direction 8.2 which is marked by a double arrow. The first eccentric 27 is guided by way of its guide region 27.2 in the second elongated hole 21.2 of the cover 20 and is mounted so as to be rotatable in the bore 12 of the base plate 10 by way of its eccentric cam 27.3 outside the center longitudinal axis of the first 27 eccentric. The claw 26 is held between the holding webs 23. To this end, the spindle 24 is guided through the spindle bores 23.1 of the holding webs 23 and the spindle receiving means 26.6 of the claw 26. The spindle 24, in this case, is fixed axially by means of its end-face thickening 24.1. As a result of corresponding postprocessing once it has been mounted, the spindle 24 is also realized in a thickened manner at the end opposite to the end-face thickening 24.1 such that it is not able to slide out of the spindle receiving means 26.6 and the spindle bores 23.1. The spring 25 is arranged with its winding region 25.1 in the spring receiving means 26.7 of the claw 26. The spindle 24, in this case, is guided through the winding region 25.1 and the spring 25 is held as a result. The spring clip 25.3, as shown in FIG. 5, abuts against the spring contact surface 26.9 inside the spring receiving means 26.7. The legs 25.2 of the spring 25 are guided into the region between the spring guides 21.3 of the cover 20. They abut there against the side of the guide portion 21 of the cover 20 facing the base plate 10. The spring 25 is preloaded and transmits a torque to the claw 26. The claw 26 is rotated into a first position by the spring 25. In said first position, the claw 26 abuts by way of its stop cam 26.8 against the stop surfaces 23.2 of the holding webs 23.

The cover 20 is able to be adjusted by means of the first eccentric 27 in the direction of the y axis 8.2 in relation to the base plate 10.

Figure 4:
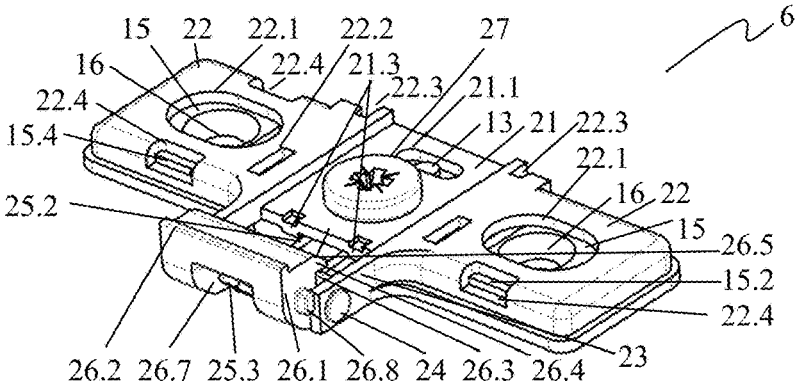
FIG. 4 shows a perspective view of the mounting plate shown in FIG. 3.

With reference to the description regarding FIG. 3, FIG. 4 shows a perspective view of the mounting plate 6 shown in FIG. 3. In said perspective view, the arrangement of the spring clip 25.3 in the spring receiving means 26.7 of the claw 26 can be seen. The claw 26 abuts against the stop surfaces 23.2 formed by the holding webs 23 on account of the spring force applied by way of its stop cams 26.8. In said first position of the claw 26, the claw opening 26.3 is aligned in the direction of the plane of the mounting surface 10.1 shown in FIG. 2.

FIG. 5 shows a sectional representation from the side of the mounting plate 6 shown in FIG. 3. In this case, the line of the cut is marked with a V in FIG. 3. The base plate 10 comprises the mounting surface 10.1 by way of which the mounting plate 6 abuts against the furniture carcass 3 when the furniture hinge 1 is mounted. The shoulder 14 is preferably attached to the mounting plate 6, in particular to the base plate 10 of the mounting plate 6, and projects beyond the mounting surface 10.1 of the mounting plate 6 in such a manner that it delimits said mounting plate in one direction. The mounting plate 6 can thus be placed with the mounting surface 10.1 against the frame 4 of a furniture carcass and can be aligned in relation to said frame by means of the stop 14. The eccentric cam 27.3 of the first eccentric 27 is received in the bore 12 of the base plate 10. The edge 12.1 of the bore 12 is raised in relation to the mounting surface 10.1. A cavity is consequently formed between the lower surface of the edge 12.1 and the mounting surface 10.1. In the region of the cavity, the diameter of the eccentric cam 27.3 is enlarged compared to the diameter of the bore 12. At the same time, the first eccentric 27 rests with its eccentric head, which carries the tool receiving means 27.1, on the edge region of the second elongated hole 21.2 of the cover 20, as can clearly be seen in FIG. 4. The first eccentric 27 is consequently blocked axially and forms a connection which is axially blocked and is displaceable on the flat between the base plate 10 and the cover 20. As a result of rotating the first eccentric 27, preferably by means of a tool which is inserted into the tool receiving means 27.1, it is rotated about the eccentric cam 27.3 which is fixed in the bore 12 of the base plate 10. As a result of the rotational movement of the first eccentric 27, the cover 20 is displaced in relation to the base plate 10 in the direction of the y axis 8.2 and consequently transversely to the pivot axis of the furniture hinge 1 through the guide region 27.2 of the first eccentric 27 which abuts at the side against the edge of the second elongated hole 21.2 of the cover 20. As can be seen in FIG. 1, the height of the position of the mounted furniture door 5 is able to be adjusted as a result.

The claw 26 is mounted so as to be rotatable on the holding webs 23 of the cover 20 by means of the spindle 24. The spindle 24 is guided by the winding region 25.1 of the spring 25. The spring 25 is held as a result. The legs 25.2 of the spring 25 are guided to the cover 20 and abut against said cover. The oppositely situated spring clip 25.3 is guided in an angled manner to the spring contact surface 26.9 of the claw 26. The spring contact surface 26.9 is attached to the basic body 26.1 of the claw 26 in a chamfered manner such that the spring clip 25.3 abuts thereon. The spring 25 is preloaded. It presses the claw 26 consequently into its first position shown in FIG. 5. In said position, the claw opening 26.3 is aligned toward the cover 20. In the first position of the claw 26, the claw opening 26.3 is preferably aligned parallel to the mounting plane 10.1. As a result of pressure on the claw 26, said claw is able to be rotated about the spindle 24 into a second position in opposition to the spring force. In this case, the claw opening 26.3 is aligned sloping upward, with reference to the mounting surface 10.1. The rotation of the claw 26 can be effected manually, as result of which, for example, the web 26.2 is suitable as a point of cooperation for manual actuation. The claw 26 can also be rotated as a result of pressure exerted onto the run-up slope 26.5. If such pressure is exerted, for example by a pressed component, in the direction of the mounting plane 10.1 onto the run-up slope 26.5, said run-up slope is adjusted in opposition to the spring force on account of its inclination. If the run-up slope 26.5 is released again, the spring 25 adjusts the claw 26 back into its first position.

Figure 6:
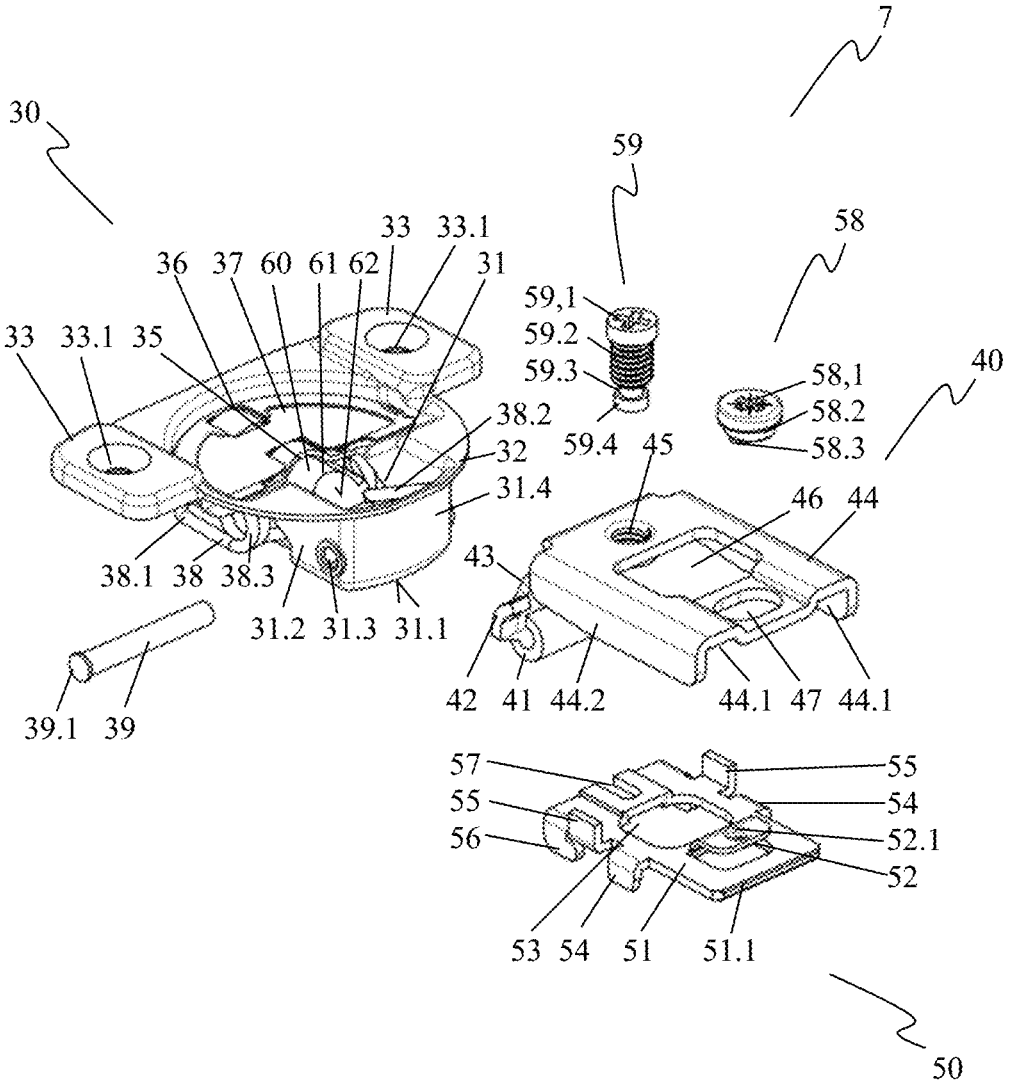
FIG. 6 shows an exploded drawing of a hinge body with a hinge cup for fastening the furniture hinge to a furniture door.

FIG. 6 shows an exploded drawing of the hinge body 7 with a hinge cup 30 for fastening the furniture hinge 1 to a furniture door 5. In addition, the hinge body 7 has assigned thereto a hinge arm 40 and in the present case a connection element 50. The hinge arm 40 may also be described as including the connection element 50.

Figure 14:
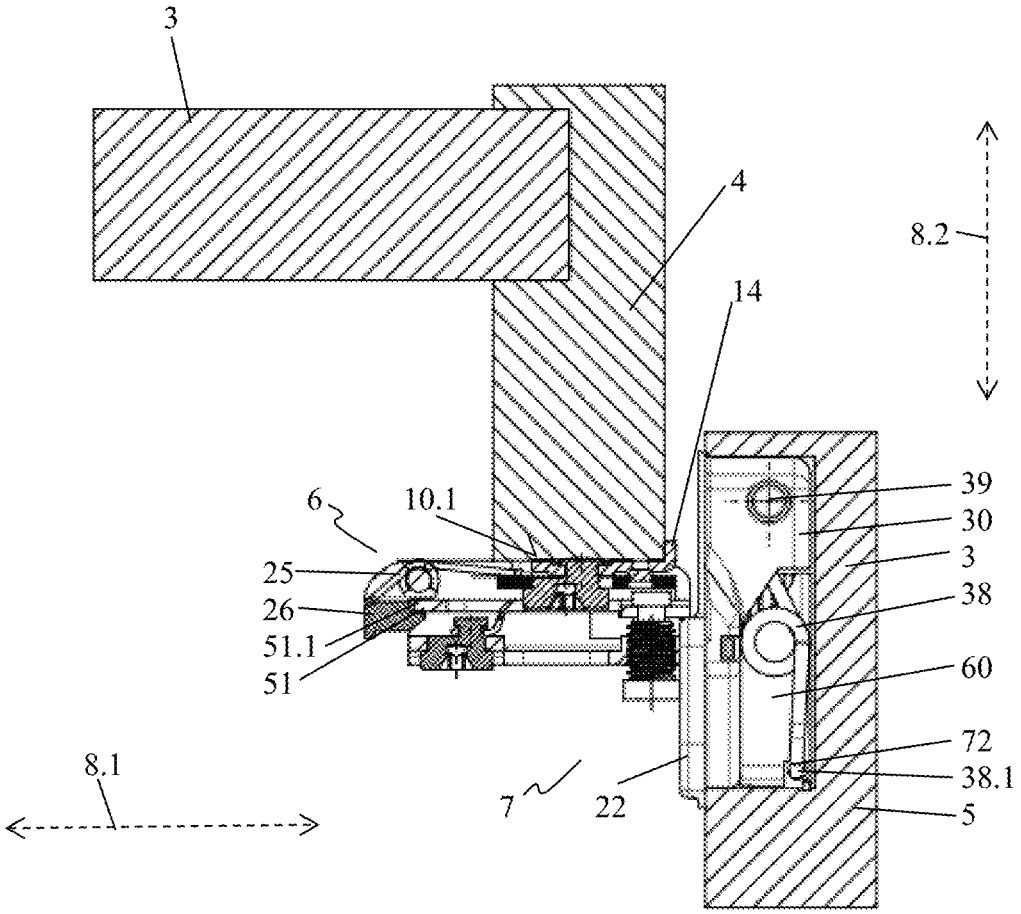
FIG. 14 shows a side view of the furniture hinge mounted on an item of furniture.

As shown in FIG. 1 and in particular in FIG. 14, the hinge cup 30 can be inserted into a bore in the furniture door 5 and screw-connected to the furniture door 5 by way of screws which are guided through side flanges 33 which are integrally molded on the sides of the hinge cup 30. The side flanges 33 are penetrated by mounting bores 33.1 for this purpose. Proceeding from an outer contact surface 32, a centering region 31 forms an indentation which merges into a mounting region 34 (see FIG. 9) of the hinge cup 30, said mounting region also being realized as an indentation. Toward the furniture door 5 (see FIG. 14), the mounting region 34 is closed off by a bottom. Latching recesses (not shown) are provided in the form of breakthroughs in the bottom. Fastening elements, realized as latching elements, are latched in the latching recesses. The fastening elements are part of a housing 70 shown in FIG. 9 for receiving a damper 60. The damper 60 is consequently arranged outside the hinge cup 30 below the bottom of the mounting region 34. In order to create sufficient space for receiving the damper 60, the bottom comprises an indent 36 along which the damper 60 is arranged. The mounting region 34 of the hinge cup 30 is covered by a cover 37.

A portion of the damper 60 is inserted into the centering region 31 through an opening 35. In the exemplary embodiment shown, a movably mounted cylinder 61 of a linear damper is inserted into the centering region 31. The cylinder 61 comprises an inclination 62 on the end face.

A second spring 38 is also arranged outside the hinge cup. It is guided through the opening 35 into the centering region 31 by way of its free ends 38.2. The second spring 38, realized as a leg spring, comprises a winding 38.3 and a second spring clip 38.1.

The centering region 31 is formed by cup side walls 31.2, a rounding portion 31.4 as well as a cup bottom 31.1. Joint receiving means 31.3 in the form of bores are provided in the opposite cup side walls 31.2. The joint receiving means 31.3 have assigned thereto an articulation bolt 39 with an end-face stop portion 39.1.

The hinge arm 40 comprises an articulated lever 43. A bolt receiving means 41 is integrally molded onto the end of the articulated lever 43 facing the hinge cup 30.

The bolt receiving means 41 is realized as a cylindrically curved end region of the articulated lever 43. Two guide curves 42 are arranged on the articulated lever 43 on opposite sides in the region of the bolt receiving means 41.

The articulated lever 43 is connected in one piece to a mounting portion 44 of the hinge arm 40. The mounting portion 44 is preferably realized as a punched part. It comprises side regions 44.2 which are angled at the side toward the connection element 50. These form guides 44.1 which are aligned in the direction of the longitudinal extension of the hinge arm 40. A thread receiving means 45, a recess 46 and a fourth elongated hole 47 are provided in the mounting portion 44.

The connection element 50 is arranged opposite to the mounting portion 44 of the hinge arm 40. It comprises a flat basic body 51. A through-opening 53 is provided in the basic body 51. The through-opening 53 is arranged so as to be flush with the recess 43 of the mounting portion 44 of the hinge arm 40. An adjusting element receiving means 57, in the form of a slot which extends from the edge of the connection element 50, is provided in the basic body 51 pointing toward the articulated lever 43 of the hinge arm 40. The adjusting element receiving means 57 is arranged opposite to the thread receiving means 45 of the mounting portion 44 of the hinge arm 40. Congruently to the fourth elongated hole 47 of the mounting portion 44, a flap 52 with a bore 52.1 is formed out of the plane of the basic body 51 of the connection element 50. The flap 52, in this case, is raised in the direction of the mounting portion 44 above the surface of the basic body 51. It is aligned at least approximately parallel to the surface of the basic body 51 in the region of the bore 52.1. The basic body 51 of the connection element 50 is closed off at the end by way of a holding portion 51.1. The holding portion 51.1 is consequently formed by a front edge of the connection element 50. It is arranged opposite to the adjusting element receiving means 57.

Proceeding from the side of the mounting portion 44 facing the articulated lever 43, two hooks 56 are integrally molded on the sides of the connection element 50. The hooks 56 are angled in relation to the surface of the basic body 51. They point in the direction remote from the mounting portion 44. The hooks 56 are open in the direction of the holding portion 51.1 of the connection element 50. Two guide flaps 55, connected to the hooks 56 and situated opposite one another, are angled out of the plane of the basic body 51 in the direction of the mounting portion 44 of the hinge arm 40. The distance between the guide flaps 55 is less than the distance between the side regions 44.2 of the mounting portion 44. Two holding flaps 54, which are arranged opposite one another, are subsequently integrally molded on the sides of the basic body 51 and are angled toward the side of the basic body 51 remote from the mounting portion 44 of the hinge arm 40.

The hinge body 7 has assigned thereto a second eccentric 58. The design of the second eccentric 58 corresponds to that of the first eccentric 27. It comprises accordingly a second tool receiving means 58.1, a second guide region 58.2 and a second eccentric cam 58.3.

In addition, the hinge body 7 has assigned thereto an adjusting screw 59 with a third tool receiving means 59.1, a thread 59.2, a groove 59.3 and a closure 59.4.

Figure 7:
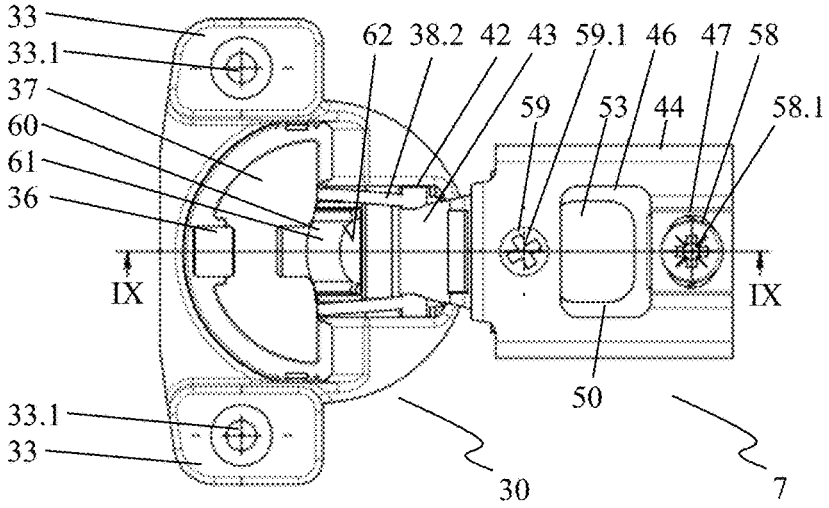
FIG. 7 shows a top view of the assembled hinge body shown in FIG. 6.

FIG. 7 shows a top view of the assembled hinge body 7 shown in FIG. 6. The articulated lever 43 is guided into the centering region 31 of the hinge cup 30 and is fixed there in an articulated manner. To this end, the articulated bolt 39 shown in FIG. 6 is guided by the joint receiving means 31.3 of the side walls 31.2 of the centering region 31 and the bolt receiving means 41 of the articulated lever 43 and is fixed axially by end-face stops 39.1. The free ends 38.2 of the second spring 38 rest on the guide curves 42 on the articulated lever 43 and transmit a spring force onto them. The guide curves 42, in this case, are designed such that, from a certain opening angle of the furniture hinge 1, the second spring 38 supports an opening movement and, from a certain closing angle of the furniture hinge 1, a closing movement of the furniture hinge 1 and consequently of the connected furniture door 5. The damper 60 is inserted by way of the inclination 62 of its cylinder 61 into the centering region 31 and consequently into the adjustment path of the articulated lever 43. When the furniture hinge 1 is closed, the articulated lever 43 abuts against the inclination 62 of the damper 60 and compresses it. This damps the closing movement of the furniture hinge 1 in its last movement portion.

Figure 9:
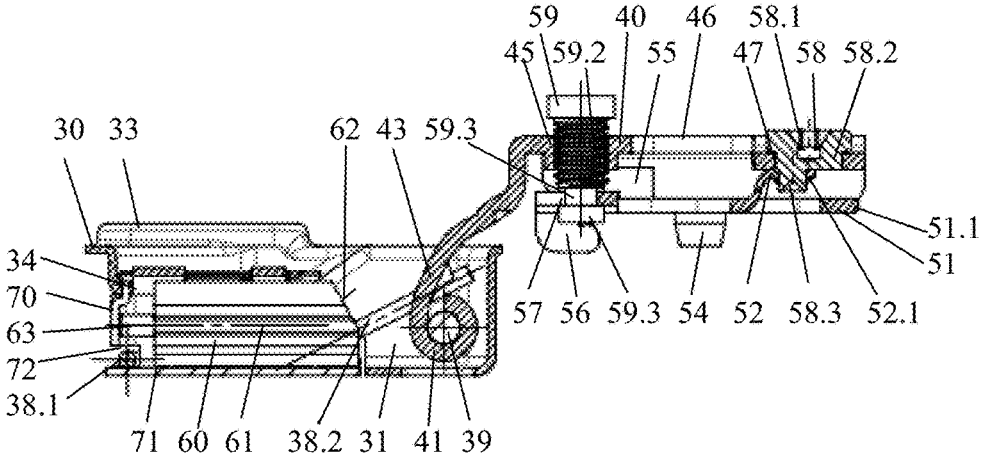
FIG. 9 shows a sectional representation from the side of the hinge body shown in FIG. 7.

The mounting portion 44 of the hinge arm 40 is connected to the connection element 50, as is described in more detail with regard to FIG. 9. In this case, the cut surface of the sectional representation shown in FIG. 9 extends along the cutting line marked by way of the reference IX. The second eccentric 58 is guided through the fourth elongated hole 47 to the bore 52.1 in the flap 52 of the connection element 50. The adjusting screw 59 is screwed into the thread receiving means 45 of the hinge arm 40.

Figure 8:
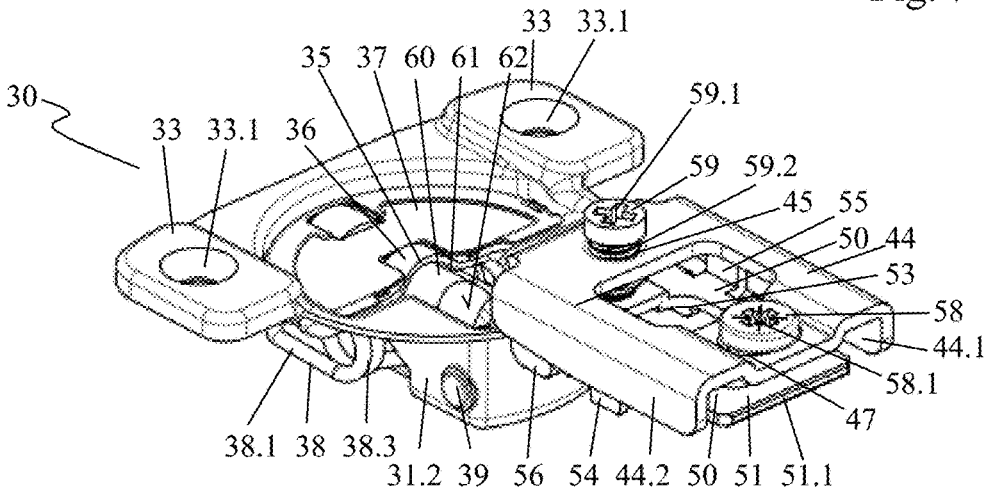
FIG. 8 shows a perspective view of the hinge body shown in FIG. 7.

FIG. 8 shows a perspective view of the hinge body shown in FIG. 7. As can be seen in said view, the second spring 38 is arranged outside the hinge cup 30 and, as can be seen in FIG. 7, is guided through the opening 35 into the centering region 31 of the hinge cup. The damper 60 is also arranged with its housing 70 below the mounting region 34 of the hinge cup 30 and is guided through the opening 35 into the centering region 31.

The adjustment screw 59 is screwed into the thread receiving means 45 on the mounting portion 44 of the hinge arm 40 by way of its thread 59.2 and is rotatably mounted at the end of the adjustment element receiving means 57 of the connection element 50. The holding portion 51.1, as an edge of the basic body 51 of the connection element 50 remote from the articulated lever 43, closes off with the mounting portion 44 of the hinge arm 40. It is arranged, in this case, at a spacing from the mounting portion 44 and between the two side regions 44.2 integrally molded thereon.

FIG. 9 shows a sectional representation from the side of the hinge body 7 shown in FIG. 7. The cut, in this case, extends along the cutting edge characterized in FIG. 7 by way of the reference IX.

The articulated lever 43 is pivotably mounted on the hinge cup 30 inside the centering region 31. It connects the hinge cup 30 to the mounting portion 44. The articulated lever 43 is connected in one piece to the mounting portion 44. Proceeding from the outer contact surface 32, the centering region 31 forms an indentation. The mounting region 34 also realizes such an indentation. In this case, the cup depth in the mounting region 34 is smaller than in the centering region 41. The mounting region 34 is closed off by a cup bottom. The damper 60 is attached from the outside to the cup bottom of the mounting region 34. The damper 60 is mounted in the housing 70 for this purpose. The housing 70 is fastened to the cup bottom of the mounting region 34. A housing bottom 71 is preferably arranged in the same plane as the cup bottom of the centering region 31. The damper 60 is realized as a linear damper, preferably as a hydraulic linear damper. The cylinder 61 of the damper 60 is guided in a linearly movable manner in the housing 70. The end-face inclination 62 on the cylinder 61 of the damper 60 is guided into the centering region 31 of the hinge cup 30. The inclination 62 of the movably mounted cylinder 61 of the damper 60 consequently lies in the adjustment region of the articulated lever 43. Located opposite, a piston 63 of the damper 60 is fixed to a side wall of the housing 70. When closing the furniture hinge 1, the articulated lever 43 presses against the inclination 62 of the cylinder 61 and displaces it in the direction of the piston 63. As a result, the movement of the articulated lever 43 and consequently the closing movement of the furniture hinge 1 are damped.

A spring receiving means 72 is attached to the housing 70. The spring receiving means 72 is realized as a groove in the housing wall. The second spring clip 38.1 of the second spring 38 is fixed in the spring receiving means 72. The second spring 38 is accordingly mounted on the housing 70 from the outside. The housing 70 consequently carries the damper 60 and the second spring 38. It can be fastened as a structural unit to the bottom of the mounting region 34 of the hinge cup 30. The free ends 38.2 of the second spring 38 are guided through the opening 35 into the centering region 31 of the hinge cup 30. They abut against the guide curves 42 on the articulated lever 43 and each support, from a certain opening angle, the opening or closing operation of the furniture hinge 1.

The adjustment screw 59 is screwed into the thread receiving means 45 on the mounting portion 44 of the hinge arm. The groove 59.3 is arranged in the adjustment element receiving means 57 of the connection element 50 and is held axially by the closure 59.4, the cross section of which is enlarged compared to that of the groove 59.3. The adjustment screw 59 consequently connects the hinge arm 40 to the connection element 50. The distance between the connection element 50 and the hinge arm 40 can be adjusted by means of the adjustment screw 59. The furniture door 5 can consequently be adjusted corresponding to FIG. 1 in the direction of the z axis 8.3 of the system of coordinates 8 shown there. A door gap can consequently be adjusted with the adjustment screw 59.

The second eccentric 58 is guided by way of its guide region 58 in the fourth elongated hole 47 on the hinge arm 40. At the same time, the second eccentric 58 is fixed axially in the bore 52.1 of the flap 52 on the connection element 50. The second eccentric 58 consequently also connects the connection element 50 to the hinge arm 40. As a result of rotating the second eccentric, the hinge arm 40 is adjusted in relation to the connection element 50. The furniture door 5 is consequently displaced along the x axis 8.1 according to FIG. 1.

At the end the connection element 50 closes off flush by way of its holding portion 51.1 with the mounting portion 44 of the hinge arm 40. The holding portion 51.1 thus realizes an edge that is accessible from the outside.

The hooks 56 are integrally molded on the connection element 50 on the side facing the articulated lever 43. The openings of the hooks 56, in this case, are aligned in the direction of the holding portion 51.1.

Figure 10:
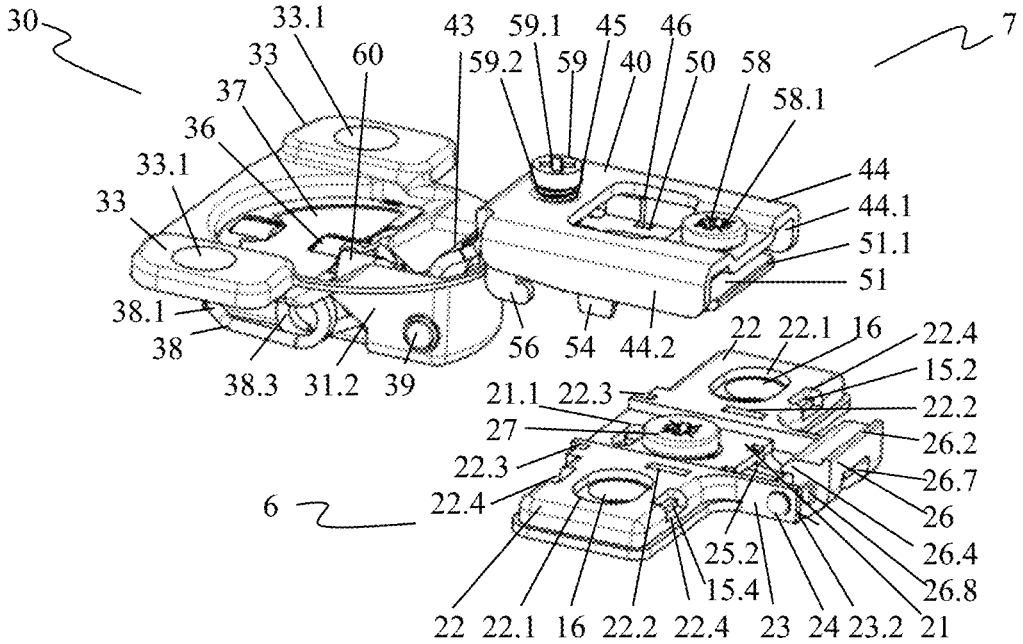
FIG. 10 shows a perspective view of the hinge body and the mounting plate in a mounting position aligned with respect to one another.

FIG. 10 shows a perspective view of the hinge body 7 and the mounting plate 6 in a mounting position aligned to one another. To this end, the hinge body 7 with its mounting region 44 is arranged at a spacing from the guide portion 21 of the cover 20 of the mounting plate 6. In said position, the hooks 56 lie in alignment with the hook receiving means 22.3. The holding flaps 54 are aligned toward the guide slots 22.2. The holding portion 51.1 is arranged at a spacing from the claw 26. The holding portion 51.1 is preferably aligned so as to be flush with the run-up slope 26.5 of the claw 26.

To connect the hinge body 7 to the mounting plate 6, the hooks 56 are suspended in the hook receiving means 22.3. The mounting region 44 of the hinge arm 40 is then rotated about the hook receiving means 22.3 with the connected connection plate 50. As a result, the holding flaps 54 are inserted into the assigned guide slots 22.2. The connection element 50 presses by way of its holding portion 51.1 onto the run-up slope 26.5 of the claw 26. As a result, the claw 26 is rotated about the spindle 24 in opposition to the acting spring force. In this case, the claw opening 26.3 is aligned in the direction of the abutting holding portion 51.1 of the connection element 50. The claw 26 is rotated until the holding portion 51.1 slides into the claw opening 26.3. When there is not any pressure exerted onto the run-up slope 26.5, the claw 26 is adjusted into its first position again. As a result, it encompasses the holding portion 51.1. The hinge arm 30 is consequently blocked by the hooks 56 in one direction along the longitudinal extension of the furniture hinge 1 and by the claw 26 in the opposite direction. On account of the blocking by the claw 26, the hooks 56 are not able to slide out of the hook receiving means 22.3. This prevents the hinge arm 40 coming free from the mounting plate 6. In the lateral direction, the hinge arm 40 is blocked in relation to the mounting plate 6 by the hooks 56 and the holding flaps 54 received in the guide slots 22.2.

A connection system, which is able to be closed without the use of a tool, is created by the claw 26 and the hooks 56 in combination with the holding portion 51.1 and the hook receiving means 22.3. This is effected simply as a result of the hooks 56 being hooked into the hook receiving means 22.3 and then the mounting portion 44 being pressed onto the mounting plate 6. The claw 26, as the provided blocking element, is adjusted from a first into a second position as a result of said mounting movement. In said second position, the holding portion 51.1 can be inserted into the claw opening 26.3. The spring 25 then adjusts the claw 26 into it first position again in which the hinge arm 40 or the connection element 50 fixed to the hinge arm 40 is fixed to the mounting plate 6. The connection system may also be referred to as a releasable connector.

For fastening the hinge arm 40 to the mounting plate 6, the claw 26 as the connection element can also be adjusted manually from its first into the second position. The web 26.2 forms a suitable control element for this purpose.

For releasing the connection between the hinge body 7 and the mounting plate 6, the claw 26 can be adjusted manually into its second position. As a result, the claw 26 releases the holding portion 51.1. The hooks 56 can then be hooked out of the hook receiving means 22.3 and the connection released. The connection system can accordingly also be released again without the use of a tool.

Figure 11:
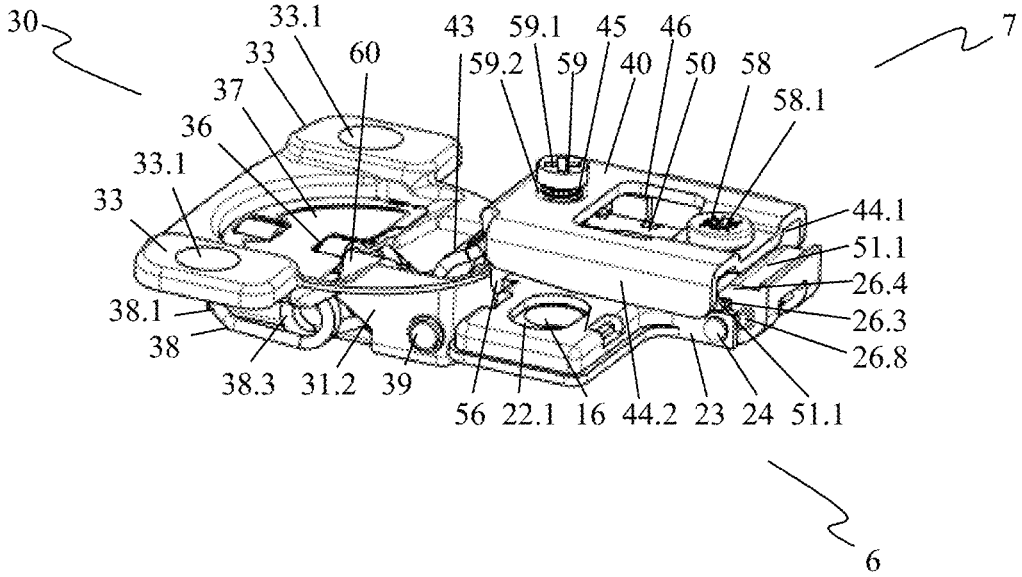
FIG. 11 shows a perspective view of the assembled furniture hinge.

FIG. 11 shows a perspective view of the assembled furniture hinge 1. The hooks 56 are hooked into the associated hook receiving means 22.3. The holding portion 51.1 is held in the claw opening 26.3. The hinge arm 40 is consequently fixed to the mounting plate 6.

Figure 12:
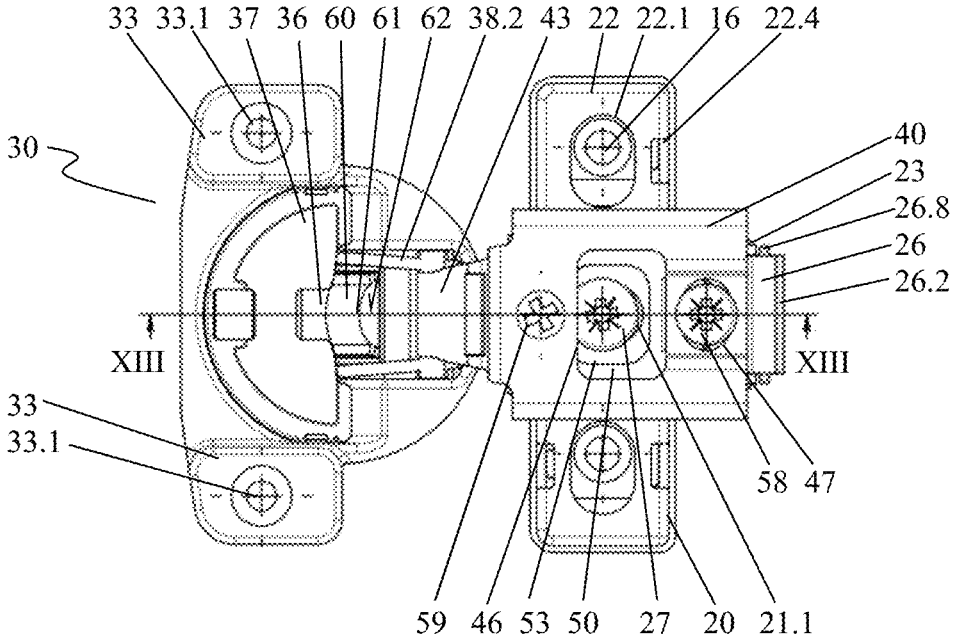
FIG. 12 shows a top view of the furniture hinge shown in FIG. 11.

FIG. 12 shows a top view of the furniture hinge 1 shown in FIG. 11. The hinge arm 40 is able to be adjusted in relation to the mounting plate 6 in three directions in space, as are shown by the system of coordinates 8 according to FIG. 1, by means of the adjustment screw 59, the first eccentric 27 and the second eccentric 58. As a result, a furniture door 5 is able to be aligned precisely in relation to a furniture carcass 3. The claw 26, as blocking element, is freely accessible. It can consequently be adjusted without the use of a tool and consequently the connection between the hinge body 7 and the mounting plate 6 can be released.

Figure 13:
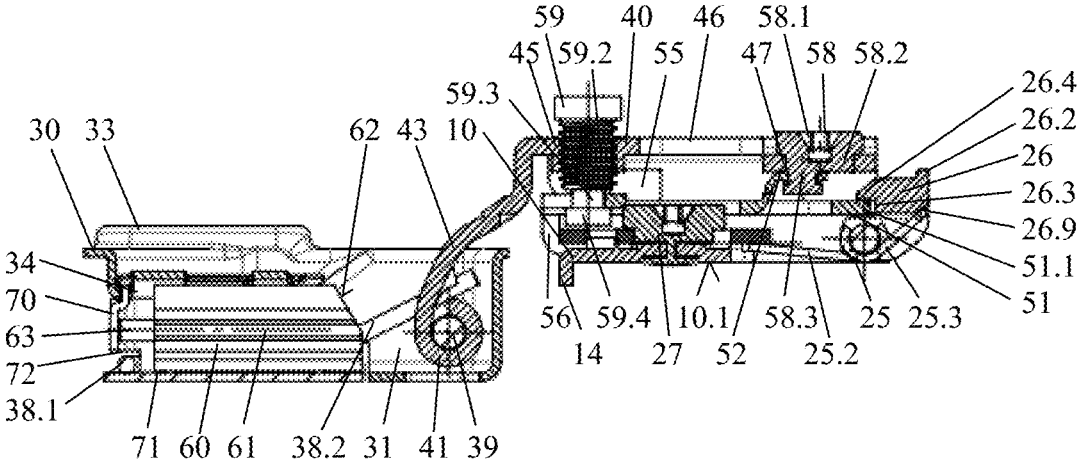
FIG. 13 shows a sectional representation from the side of the furniture hinge shown in FIG. 11

FIG. 13 shows a sectional representation from the side of the furniture hinge 1 shown in FIG. 11. The cutting edge, in this case, is shown in FIG. 12 and marked by way of the reference XIII. The furniture hinge 1 is shown in its open position, as is present in the case of an open furniture door 5.

It can easily be seen in the sectional representation shown that the holding portion 51.1 of the connection element 50 is fixed in the claw opening 26.3 of the claw 26 and consequently, in conjunction with the hooks 56, a movement of the hinge arm 40 in relation to the mounting plate 6 is blocked. As a result of pressure onto the claw 26 in the region of the web 26.2, said claw can be rotated about the spindle 24 in opposition to the spring force applied by the spring 25, clockwise in the present view. The holding portion 51.1 is released as a result. The hinge arm 40 can then be released from the mounting plate 6.

FIG. 14 shows a side view of the furniture hinge 1 mounted on an item of furniture 2. The hinge cup 40 is fixed in a bore on the furniture door 5 and is screwed onto the furniture door 5 at the side of the flanges 22. The mounting plate 6 is fastened to a frame 4 of the item of furniture 2. To this end, the mounting plate 6 abuts against the frame 4 by way of its mounting surface 10.1. The stop 14 abuts against the edge of the frame 4. The position of the mounting plate 6 is fixed as a result. The mounting plate 6 is fastened to the frame 4 by means of screws (not shown) which are guided through the mounting bores 16 of the base plate 10.

For mounting the furniture door 5, the mounting plate 6 and the hinge body 7 are present in a separate manner. Both are premounted. First of all, the mounting plate 6 is aligned with the stop 14 on the frame 4. The mounting plate 6 is then screw-connected to the frame 4. The hinge cup 30 is inserted into the bore of the furniture door 5, aligned and screw-connected to the furniture door 5. Where multiple furniture hinges 1 are provided, they are mounted in a corresponding manner. The furniture door 5 is then held at the opening of the furniture carcass 2 and is aligned such that the mounting portion 44 of the hinge arm 40 lies above the assigned mounting plate 6. Said mounting position can be seen in particular in FIG. 10. The hooks 56 of the connection element 50 are then hooked into the hook receiving means 22.3 of the mounting plate 6 and the mounting portion 44 of the hinge arm 40 is pressed against the mounting plate 6. In this case, the claw 26 opens and surrounds the holding portion 51.1 of the connection element 50 by way of its claw opening 26.3. The hinge body 7 is thus fixed to the mounting plate 6.

The furniture door 5 can be connected to the furniture carcass 3 quickly, simply and without the use of a tool as a result of the furniture hinge 1 according to the invention. By adjusting the claw 26 manually, the furniture door 5 can also be released from the furniture carcass 3 in a simple, quick and tool-free manner. The furniture hinge 1 can preferably be used for mounting on the frames (face frame) of items of furniture 2.

The invention claimed is:

1. A furniture hinge for articulated fastening of a pivoted furniture part to a furniture carcass, the furniture hinge comprising:

a mounting plate configured to be fastened to the furniture carcass;

a hinge body configured to be fastened to the pivoted furniture part;

a hinge arm pivotably mounted on the hinge body; and a releasable connector configured to be closed to releasably fasten the hinge arm indirectly or directly to the mounting plate in a tool-free manner;

wherein the releasable connector includes at least one movably mounted blocking element configured to fix the hinge arm to the mounting plate in a first position of the blocking element, and to release the hinge arm from the mounting plate in a second position of the blocking element, the at least one movably mounted blocking element including a claw pivotably mounted on the mounting plate, the claw including a claw opening; and wherein the hinge arm includes a holding portion configured such that when the hinge arm is mounted on the mounting plate and the blocking element is in its first position the holding portion is received in the claw opening.

2. The furniture hinge of claim 1, wherein:

the hinge arm includes a connection element fastened to the hinge arm, the hinge arm being fastenable to the mounting plate via the connection element.

3. The furniture hinge of claim 1, wherein:

the releasable connector is configured to be opened such that the hinge arm can be released from the mounting plate in a tool-free manner.

4. The furniture hinge of claim 1, wherein:

the releasable connector includes a spring configured to provide a spring force biasing the blocking element toward the first position, such that movement of the blocking element into the second position is in opposition to the spring force applied by the spring.

5. The furniture hinge of claim 4, wherein:

the releasable connector is configured such that the blocking element is movable from its first position to its second position by a mounting movement between the hinge arm and the mounting plate, and such that after the hinge arm is in a mounted position on the mounting plate the spring moves the blocking element back to its first position.

6. The furniture hinge of claim 1, wherein:

one of the hinge arm and the mounting plate includes at least one hook;

the other of the hinge arm and the mounting plate includes at least one hook receiving receptacle; and the at least one movably mounted blocking element is configured to block the at least one hook in a hooked-in position in the at least one hook receptacle when the blocking element is in its first position, and to release the at least one hook from the hooked-in position when the blocking element is in its second position.

7. The furniture hinge of claim 1, wherein:

the claw includes a run-up slope; and the holding portion and the run-up slope being configured such that during a mounting movement of the hinge arm relative to the mounting plate the holding portion engages the run-up slope and biases the blocking element away from the first position.

8. The furniture hinge of claim 1, wherein:

the hinge arm includes at least one hook, the hook having a hook opening; and wherein the claw opening is aligned opposite to the hook opening in the first position of the at least one movable blocking element.

9. The furniture hinge of claim 1, wherein:

the hinge arm includes a connection element fastened to the hinge arm, the hinge arm being fastenable to the mounting plate via the connection element; and a position of the connection element is adjustable in relation to the hinge arm.

10. The furniture hinge of claim 1, wherein:

the mounting plate includes a base plate and a cover, a position of the cover being adjustable in relation to the base plate; and the hinge arm is fastenable indirectly or directly to the cover.

11. The furniture hinge of claim 1, wherein:

the mounting plate includes a mounting surface for abutment against the furniture carcass, and the mounting plate includes a stop projecting beyond the mounting surface.

12. The furniture hinge of claim 1, wherein the hinge body comprises:

a hinge cup, including a centering region, a mounting region and a cup bottom, the hinge cup having a cup depth, the cup depth being reduced in the mounting region as compared to the centering region;

a housing fastened from an outside of the hinge cup to the bottom of the hinge cup;

a damper received in the housing, the damper extending through an opening into the centering region of the hinge cup; and wherein the hinge arm includes an articulated lever pivotably mounted in the centering region of the hinge cup.

13. A furniture hinge for articulated fastening of a pivoted furniture part to a furniture carcass, the furniture hinge comprising:

a mounting plate configured to be fastened to the furniture carcass;

a hinge body configured to be fastened to the pivoted furniture part;

a hinge arm pivotably mounted on the hinge body;

a connection element fastened to the hinge arm; and a releasable connector configured to be closed to releasably fasten the connection element to the mounting plate in a tool-free manner, and configured to be opened to release the connection element from the mounting plate in a tool-free manner, the releasable connector including:

a movably mounted blocking element mounted on the mounting plate and configured to fix the connection element to the mounting plate in a first position of the blocking element, and to release the connection element from the mounting plate in a second position of the blocking element; and a spring configured to provide a spring force biasing the blocking element toward the first position, such that movement of the blocking element into the second position is in opposition to the spring force applied by the spring;

wherein the releasable connector is configured such that the blocking element is movable from its first position to its second position by a mounting movement between the connection element and the mounting plate, and such that after the connection element is in a mounted position on the mounting plate the spring moves the blocking element back to its first position.

14. The furniture hinge of claim 13, wherein:

the connection element includes at least one hook;

the mounting plate includes at least one hook receiving receptacle; and the blocking element is configured to block the at least one hook in a hooked-in position in the at least one hook receptacle when the blocking element is in its first position, and to release the at least one hook from the hooked-in position when the blocking element is in its second position.

* * * * *